US006609676B2

(12) United States Patent
Wilson

(10) Patent No.: US 6,609,676 B2
(45) Date of Patent: Aug. 26, 2003

(54) WIRE REEL

(76) Inventor: Mike Wilson, Reel Solutions, 10-H Pinehurst Manor, Pinehurst, NC (US) 28374

( * ) Notice: Subject to any disclaimer, the term of this patent is extended or adjusted under 35 U.S.C. 154(b) by 0 days.

(21) Appl. No.: 10/068,845

(22) Filed: Feb. 11, 2002

(65) Prior Publication Data

US 2002/0185568 A1 Dec. 12, 2002

Related U.S. Application Data

(60) Provisional application No. 60/296,455, filed on Jun. 8, 2001.

(51) Int. Cl.[7] ..... B65H 75/14

(52) U.S. Cl. ..... 242/608; 242/607; 242/608.2; 242/614

(58) Field of Search ..... 242/608, 608.2, 242/608.3, 608.4, 607, 610, 614, 118.32, 118.4, 118.6, 118.7

(56) References Cited

U.S. PATENT DOCUMENTS

| | | | | | |
|---|---|---|---|---|---|
| 335,749 | A | | 2/1886 | Fries | |
| 877,397 | A | | 1/1908 | Brinley | |
| 1,702,242 | A | * | 2/1929 | Bureau | |
| 2,058,133 | A | * | 10/1936 | Clemmons | 242/608.4 |
| 2,110,626 | A | * | 3/1938 | Hayward | 242/608.4 |
| 2,115,481 | A | * | 4/1938 | Clemmons | 242/608.4 |
| 2,741,442 | A | | 4/1956 | Aupperle | |
| 3,661,341 | A | | 5/1972 | Eifrid | |
| 3,704,838 | A | * | 12/1972 | Bernier et al. | 242/608.3 |
| 3,791,606 | A | | 2/1974 | Brown | |
| 3,817,475 | A | | 6/1974 | Goldstein | |
| 4,066,224 | A | | 1/1978 | Hargreaves et al. | |
| 4,345,724 | A | | 8/1982 | Lindell | |
| 4,895,316 | A | * | 1/1990 | Salloum | 242/608.4 |
| 5,004,179 | A | * | 4/1991 | Salloum | 242/118.6 |
| 5,242,129 | A | * | 9/1993 | Bailey et al. | 242/608.2 |
| 5,971,317 | A | * | 10/1999 | Jaros | 242/614 |
| 6,164,588 | A | * | 12/2000 | Jacobsen | 242/608.4 |
| 6,478,249 | B1 | * | 11/2002 | Orzel | 242/608.4 |

FOREIGN PATENT DOCUMENTS

| | | |
|---|---|---|
| EP | 0 567 435 A1 | 10/1993 |

* cited by examiner

*Primary Examiner*—William A. Rivera
(74) *Attorney, Agent, or Firm*—Richard C. Litman

(57) ABSTRACT

A cable reel is fabricated from wood and is of open or skeletal design while retaining the strength and ruggedness of traditional solid, metal reels. The reel includes two flanges which are constructed of a plurality of arcuate members fastened together at their ends to form an annular rim. A number of wooden spokes are provided for each rim. A main spoke spans the entire diametrical distance of the annular rim and is attached thereto. The other spokes extend radially from the center to the perimeter of the annular rim.

14 Claims, 2 Drawing Sheets

WIRE REEL

CROSS-REFERENCE TO RELATED APPLICATION

This application claims the benefit of U.S. Provisional Patent Application Serial No. 60/296,455, filed Jun. 8, 2001.

BACKGROUND OF THE INVENTION

1. Field of the Invention

The present invention generally relates to winding devices. More specifically, the present invention is drawn to a strong, lightweight reel fabricated from wooden parts.

2. Description of Related Art

The industrial reel is commonly utilized to store and transport long lengths of electric cable, steel cable and the like, economically and safely. It is common practice, after the cable has been removed, that the empty reel is returned to the cable manufacturer to be reused. This constant round trip travel results in much wear and often causes damage to the reel. Since most reels are fabricated from metal or solid wood, it is not uncommon that the damaged reel cannot be repaired and consequently must be replaced at a relatively high cost. Further, metal and solid wood reels are heavy and can only be moved or hoisted by using a great deal of "muscle power". Examples of metal reels are disclosed in U.S. Pat. No. 877,397 (Brinley), U.S. Pat. No. 3,791,606 (Brown), U.S. Pat. No. 4,345,724 (Lindell) and European Patent number 0 567 435 A1. As indicated above, metal reels are heavy and costly to replace if damaged.

U.S. Pat. No. 335,749 (Fries) and U.S. Pat. No. 3,817,475 (Goldstein) show reels fabricated from paperboard or plastic. In the instant patents, an entire flange must be replaced if a part of that flange is damaged.

U.S. Pat. No. 2,741,442 (Aupperle) shows a reel which has flanges fabricated from wood. As in the patents cited immediately above, damage to a part of the flange will require replacement of the entire flange. Further, the reel is compact and is to be utilized for winding yarn thereon. The reel therefore would not be large and rugged enough to store and transport long lengths of cable.

U.S. Pat. No. 3,661,341 (Eifrid) and U.S. Pat. No. 4,066,224 (Hargreaves et al.) disclose reels partially fabricated from wood. Damage to any part of a flange would require replacement of the entire flange.

None of the above inventions and patents, taken either singly or in combination, is seen to disclose a reel fabricated from wood parts as will subsequently be described and claimed in the instant invention.

SUMMARY OF THE INVENTION

The reel of the present invention is contemplated to be twenty-four inches or larger. The reel is fabricated from wood and is of open or skeletal design while retaining the strength and ruggedness of traditional solid, metal reels. A key component of the instant invention is the structure of the two flanges. As contemplated, each flange comprises a plurality of arcuate members fastened together at their ends to form an annular rim. A number of wooden spokes are provided for each rim. A main spoke spans the entire diametrical distance of the annular rim and is attached thereto. Arbor and drive holes are bored into the main spoke. The other spokes extend radially from the center to the inner perimeter of the annular rim.

The two flanges are connected via a number of wooden staves which are attached at their ends to the spokes and which are spaced around the center of the flanges to form the barrel portion of the reel.

Conventional truss plates are used to fasten the wooden parts together. The plates are slightly pressed below the surface of the wood to diminish the chances of the reel being damaged by the plates.

The resulting structure presents a reel which is lighter and stronger than the traditional reel, but costs approximately one-half as much to manufacture. Further, the design allows for damaged parts to be quickly and easily replaced with the use of simple hand tools.

Accordingly, it is a principal object of the invention to provide a cable reel which is strong and durable.

It is another object of the invention to provide a cable reel which can be manufactured from wood material or the like.

It is a further object of the invention to provide a cable reel with parts which can be easily and inexpensively replaced when damaged.

Still another object of the invention is to provide a cable reel, which reel is lightweight.

It is an object of the invention to provide improved elements and arrangements thereof in a cable reel for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
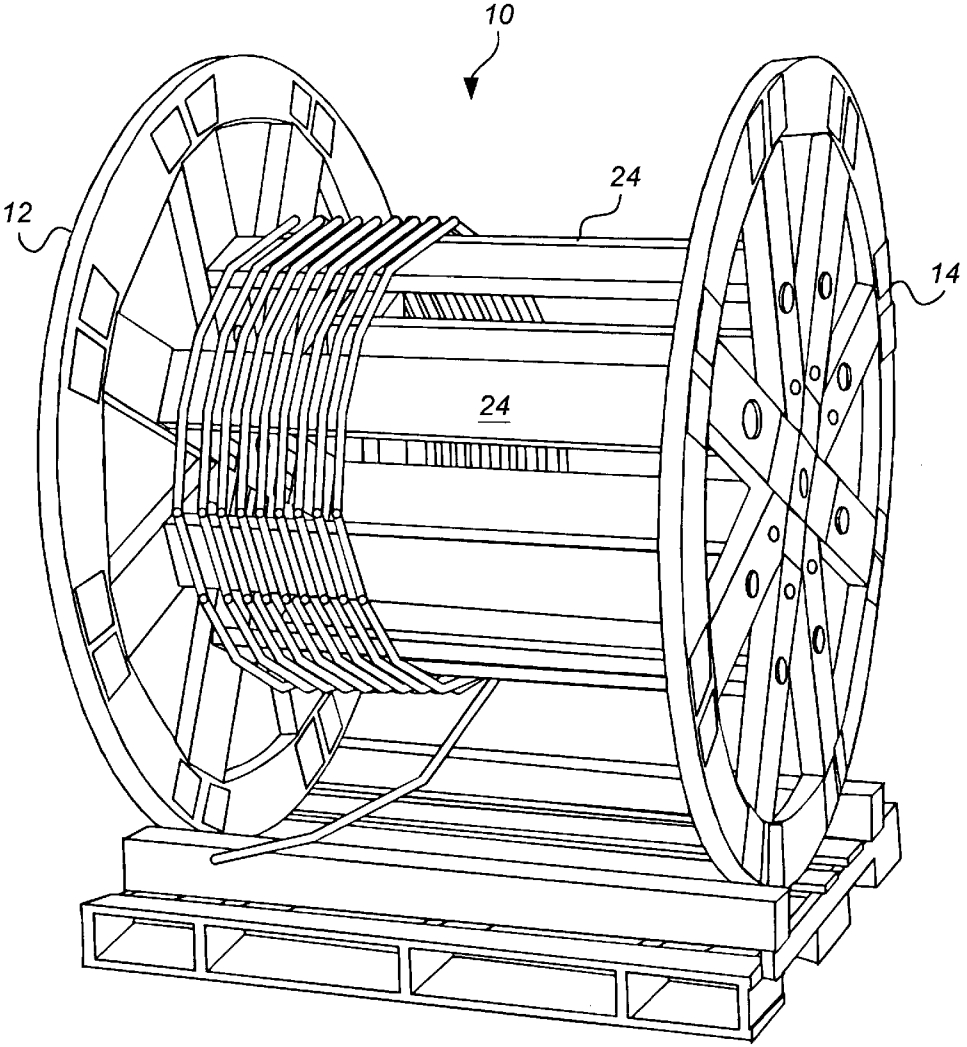
FIG. 1 is an environmental, perspective view of a cable reel according to the present invention.
Figure 2:
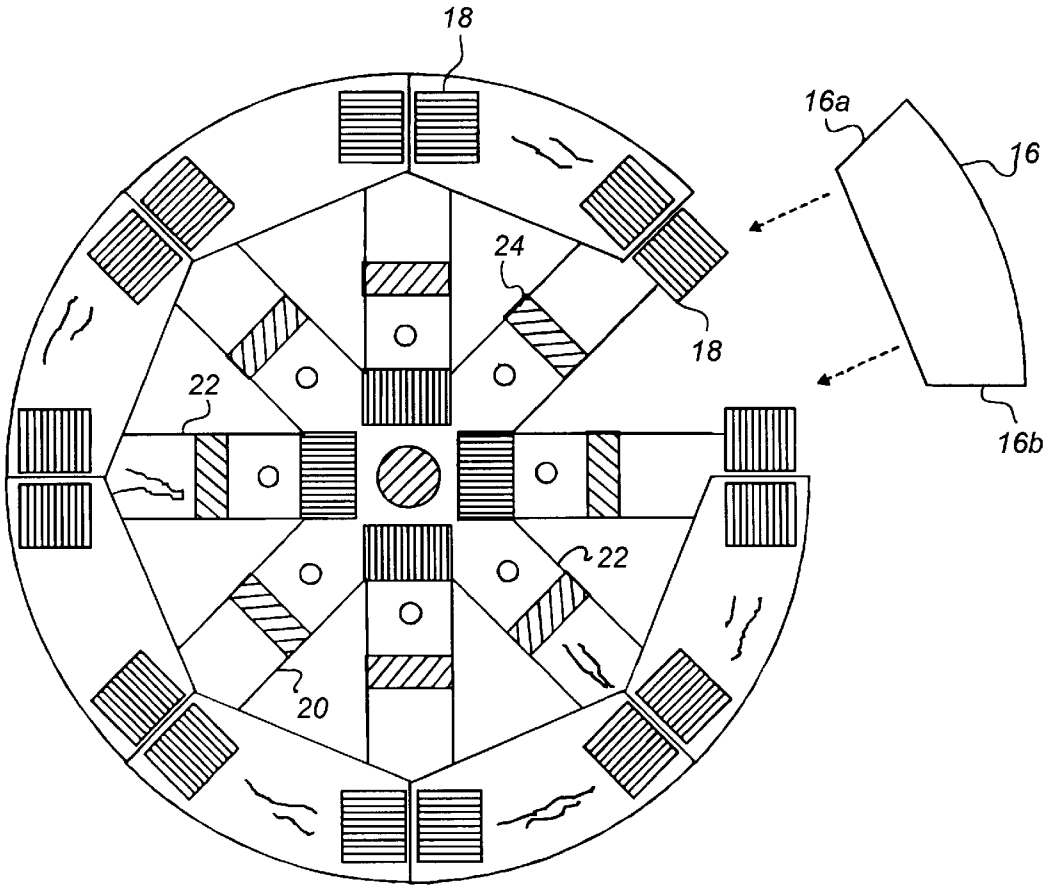
FIG. 2 is an exploded, sectional, end view of a cable reel according to the present invention.

The reel of the present invention as illustrated in FIGS. 1–2 is generally indicated at 10. The reel comprises a pair of spaced flanges 12 and 14. Each flange includes a rim constructed from a plurality of arcuate sections 16. The exact number and arcuate length of the arcuate sections is determined by the intended use and/or size of the reel. Although other suitable means may be utilized, truss plates 18 are preferred to attach the ends 16*a*, 16*b* of sections 16 to an adjacent section to form the annular rim. As indicated above, truss plates 18 are positioned slightly beneath the surface of sections 16 to minimize the possibility of damage which may be caused by truss plate snagging.

A main spoke member 20 spans the diametrical distance of each flange. Conventional arbor and drive holes are bored through member 20. Member 20 is attached to the inner diameter of the flange with a truss plate or by any suitable and convenient means. A series of radial spokes 22 extend from main spoke 20 to the inner diameter of the flange. The means for attachment of the radial spokes can be the same as for the main spoke. The number of radial spokes may vary dependent on intended reel use. Although, as illustrated, the spokes extend only to the inner diameter, it is contemplated that the spokes may be fashioned to extend to the outer diameter of the flange if desired.

A plurality of staves 24 is disposed to span the distance between spaced flanges 12 and 14. The staves 24 are spaced in a circular array so as to form the barrel portion of the reel. The ends of staves 24 are attached to the spokes 20, 22 in any convenient manner. Although wood is utilized to fabricate the main components, it is recognized that other materials of equivalent strength and cost could be substituted.

It is to be understood that the present invention is not limited to the sole embodiment described above, but encompasses any and all embodiments within the scope of the following claims.

I claim:

1. A reel for storing and transporting cable wire, said reel comprising:

a first annular flange, said first annular flange having an inner diameter and an inner perimeter;

a plurality of first arcuate sections, each of said first arcuate sections having a first end and a second end, said first arcuate sections arranged in end to end relationship to form said first annular flange;

first means for connecting each said plurality of first arcuate sections in said end to end relationship, wherein said first means for connecting are truss plates;

a first spoke member, said first spoke member spanning said inner diameter and attached at said inner perimeter of said first annular flange;

a second annular flange, said second annular flange having an inner diameter and an inner perimeter;

a plurality of second arcuate sections, each of said second arcuate sections having a first end and a second end, said second arcuate sections arranged and connected in end to end relationship to form said second annular flange;

second means for connecting each said plurality of second arcuate sections in said end to end relationship;

a second spoke member, said second spoke member spanning said inner diameter of said second annular flange and attached at said inner perimeter of said second flange; and a plurality of staves connecting said first annular flange.

2. A reel for storing and transporting cable wire as recited in claim 1, wherein said second means for connecting are truss plates.

3. A reel for storing and transporting cable wire as recited in claim 2, wherein said truss plates are positioned slightly below the surface of said first plurality of arcuate members and said second plurality of arcuate members.

4. A reel for storing and transporting cable wire as recited in claim 3, wherein said plurality of first arcuate sections and said plurality of second arcuate sections are fabricated from wood.

5. A reel for storing and transporting cable wire as recited in claim 4, wherein said first spoke member and said second spoke member are fabricated from wood.

6. A reel for storing and transporting cable wire as recited in claim 2, wherein said plurality of staves is fabricated from wood.

7. A reel for storing and transporting cable wire, said reel comprising:

a first annular flange, said first annular flange having an inner diameter and an inner perimeter;

a plurality of first arcuate sections, each of said first arcuate sections having a first end and a second end, said first arcuate sections arranged in end to end relationship to form said first annular flange;

first means for connecting said plurality of first arcuate sections in said end to end relationship, wherein said first means for connecting are truss plates;

a first spoke member, said first spoke member spanning said inner diameter and attached at said inner perimeter of said first annular flange;

a plurality of first radial spoke members, said plurality of first radial spoke members attached to said first spoke member and extending to said inner perimeter of said first annular flange;

a second annular flange, said second annular flange having an inner diameter and an inner perimeter;

a plurality of second arcuate sections, each of said second arcuate sections having a first end and a second end, said second arcuate sections arranged and connected in end to end relationship to form said second annular flange;

second means for connecting said plurality of second arcuate sections in said end to end relationship;

a second spoke member, said second spoke member spanning said inner diameter of said second annular flange and attached at said inner perimeter of said second flange;

a plurality of second radial spoke members, said plurality of second radial spoke members attached to said second spoke member and extending to said inner perimeter of said second annular flange; and a plurality of elongate staves connecting said first annular flange to said second annular flange, wherein said plurality of staves connects said first annular flange to said second annular flange in spaced relationship and wherein said plurality of staves extends around a central area of said first annular flange and said second annular flange.

8. A reel for storing and transporting cable wire as recited in claim 7, wherein said second means for connecting are truss plates.

9. A reel for storing and transporting cable wire as recited in claim 8, wherein said truss plates are positioned slightly below the surface of said first plurality of arcuate members and said second plurality of arcuate members.

10. A reel for storing and transporting cable wire as recited in claim 9, wherein said plurality of first arcuate sections and said plurality of second arcuate sections are fabricated from wood.

11. A reel for storing and transporting cable wire as recited in claim 10, wherein said first spoke member and said second spoke member are fabricated from wood.

12. A reel for storing and transporting cable wire as recited in claim 11, wherein said plurality of staves is fabricated from wood.

13. A reel for storing and transporting cable wire as recited in claim 12, wherein said plurality of first radial spoke members is fabricated from wood.

14. A reel for storing and transporting cable wire as recited in claim 13, wherein said plurality of second radial spoke members is fabricated from wood.

* * * * *